United States Patent [19]

Wynne, Jr. et al.

[11] 4,259,178

[45] Mar. 31, 1981

[54] COKE FROM COAL AND PETROLEUM

[75] Inventors: Francis E. Wynne, Jr., Allison Park; Jaime Lopez, Pittsburgh; Edward J. Zaborowsky, Harwick, all of Pa.

[73] Assignee: The United States of America as represented by the United States Department of Energy, Washington, D.C.

[21] Appl. No.: 23,803

[22] Filed: Mar. 26, 1979

[51] Int. Cl.[3] ..... C10G 9/14

[52] U.S. Cl. ..... 208/131; 208/8 R

[58] Field of Search ..... 208/8 R, 131; 201/23

[56] References Cited

U.S. PATENT DOCUMENTS

| | | | |
|---|---|---|---|
| 1,912,629 | 6/1933 | Fisher | 208/8 R |
| 3,146,183 | 8/1964 | Reed | 208/8 R |
| 4,096,097 | 6/1978 | Yan | 208/131 |

FOREIGN PATENT DOCUMENTS

| | | | |
|---|---|---|---|
| 2816527 | 10/1978 | Fed. Rep. of Germany | 208/131 |
| 51-112802 | 10/1976 | Japan | 208/131 |

OTHER PUBLICATIONS

Rose "Delayed Coking", *Hydrocarbon Processing* Jul. 1971, pp.85–92.

*Primary Examiner*—Brian E. Hearn

*Attorney, Agent, or Firm*—Donald R. Cassady; Hugh W. Glenn; Robert James Fisher

[57] ABSTRACT

A carbonaceous coke is manufactured by the delayed coking of a slurry mixture of from about 10 to about 30 weight percent of caking or non-caking coal and the remainder a petroleum resid blended at below 50° C.

1 Claim, No Drawings

COKE FROM COAL AND PETROLEUM

The Government of the United States of America has rights in this invention pursuant to Contract E (49-18)-1800 awarded by the U.S. Department of Energy.

BACKGROUND OF THE INVENTION

The coking of blends of petroleum residues with coal, coal chars, graphite fines, catalyst fines, and similar solids is well known.

U.S. Pat. No. 1,986,593; Morrell; discloses a cracking process which comprises as a portion of the process charging to a cracking chamber a mixture of 50% fuel oil and 50% raw coal. The blend is fed through a heating zone of 650° F. (343° C.) into an enlarged cracking chamber, thereafter, a portion of the volatiles from the cracking process are admixed with an inferior grade distillate and the mixture heated to about 1,000° F. (538° C.) and added to the oil-coal mixture in the cracking chamber.

U.S. Pat. No. 2,358,573; Hemminger; discloses viscosity breaking a reduced crude in the presence of a powdered carbonaceous material, as for example, granular petroleum coke.

U.S. Pat. No. 2,640,016; Martin; discloses the manufacture of metallurgical coke by coking a mixture of high volatile caking coal and from about 5 to about 25% petroleum coke at from about 892° C. to 1,204° C.

U.S. Pat. No. 3,673,080; Schlinger and Kaufman; discloses the delayed coking of high boiling liquid petroleum feedstocks in the presence of soot, particulate carbon, or catalyst fines in an amount of from about 0.01 to about 0.5 weight percent of the charge to manufacture a high compressive strength, high density, low porosity coke in clustered pellet form.

U.S. Pat. No. 3,704,224; Scovill and Day; discloses the coking of a petroleum feedstock containing catalyst fines of 0.005% and additional colloidal graphite.

U.S. Pat. No. 3,852,047; Schlinger, et al.; discloses the manufacture of clusters of petroleum coke by dispersing from about 0.01 to about 0.5 weight percent of a particulate carbon soot from the partial oxidation of fossil fuel into a petroleum resid and coking the charge in a delayed coking process.

U.S. Pat. No. 3,870,621; Arnold; discloses the fluid coking of a 50:50 mixture of non-caking coal and a residual petroleum fraction at from about 700° F. to about 900° F. (371° C. to 482° C.).

Japanese patent publication (Kokai) 51/112802; discloses mixing a caking coal with a petroleum-derived heavy oil in an amount of from 0.3 to 1.0 times the weight of oil, heating with stirring the mixture at from 400° C. to 450° C. to disperse the coal and prevent separation, then coking the mixture at abote 500° C.

SUMMARY OF THE INVENTION

The present invention is concerned with the delayed coking of mixtures of caking and non-caking coal and high boiling petroleum residues and oil. By the method of this invention, a soft, friable, porous, sponge-like mass of coke pellets is formed when a mixture of from about 10 to about 30 percent caking or non-caking coal is blended with a high boiling petroleum residue by stirring at below 65° C., then coked in a delayed coking apparatus at above 400° C.

DETAILED DESCRIPTION OF THE INVENTION

In the delayed coking of petroleum refining residues, as for example, vacuum tower bottoms, fractionator residues, reduced crude, decanted oils from catalytic crackers, and the like, the residues and mixtures thereof are preheated at above 450° C. in a preheater and then at atmospheric pressure or super-atmospheric pressure are passes into the bottom of a coking drum where vigorous cracking and coking occurs at temperatures of 450° C. to 500° C. to yield gases, gas-oil, naphthas, and a solid residue (coke).

In a large refinery operation coking is carried out continuously by operating two or more coking drums, alternately filling, cooling, decoking, and clearing each drum in succession.

In the process of the present invention a new and useful coke product is produced which is softer, more friable, more porous, and shows a characteristic appearance. This coke product contrasts to the products described by the prior art publications identified above with particular reference to the products described by Schlinger and Kaufman and by the Japanese Kokai.

By the method of the present invention, the coker charge comprising the heavy residual material identified hereinabove as comprising vacuum tower bottoms, fractionator residues, reduced crudes, decant oils, or mixtures thereof, is blended with from about 10 to about 30 weight percent of a caking or non-caking coal and mixed, as for example, with a paddle stirrer, at below about 65° C. and preferably at 50° to 65° C. Further, this invention is characterized in that no further homogenization, blending, particularization, partial dissolution, or other coalescing operations are effected on the blend prior to preheating and delayed coking.

Coals useful for the method of this invention include both caking and non-caking coals; Kentucky seam coals, as for example Kentucky No. 9 and Kentucky No. 11; Big Horn sub-bituminous coal, Sheridan, Wyoming; Pittsburgh seam coal; and the like. Coals are crushed in the manner customary for making a slurry. Particle size is not critical in the method of this invention except that the size must be manageable in the usual equipment utilized for delayed coking, preheaters, tube heaters, and the like. It has been customary to use about −40 mesh (U.S. seive size) coal with the bulk of the particles at about −200 mesh. A typical coal size is one used in the transportation of coal by pipeline slurry.

During pre-heating and coking at above about 350° C., a temperature which prevails in a delayed coking drum, the coal will coalesce with the petroleum resid. No settling, pre-coking causing clogging of pre-heaters, or the like has been observed in the operation in the method of this invention.

After a standard coking cycle, during which time the coker overheads are removed and fractionated to provide naphthas, gas-oils, and the like, the coke residue is removed hydraulically through a manhole in the bottom of the drum. The coke product is generally more porous and friable than is either regular petroleum coke or that obtained by blends of coal and resids wherein the coal is in concentrations higher than 30 percent of the charge. Upon close inspection, the coke product appears to consist of clumps of irregularly shaped particles. These particles contrast to the particles of the hard coke described in the prior art in that the individual particles are soft and the interparticulate bonding is loose and spongy, facilitating a quick and clean decoking of the coke drum.

EXAMPLE I

A sample of 1,501.6 grams of a mixture of 30 percent Kentucky seam No. 9 coal as described in Table I and 30 percent petroleum resid from a vacuum fractionation of a West Texas crude as described in Table II is blended with paddle stirring at 40° C. until the charge is homogeneous. The charge is then preheated to 146° C. at a pressure of one atmosphere and charged into a one liter drum held at 370° C. by external heating. The drum heat is raised to 433° C. over 11 hours and the volatile products are removed and condensed. The solid coke product remaining is cooled and removed from the drum.

TABLE I

VACUUM TOWER BOTTOMS

| Vacuum Residual | West Texas |
|---|---|
| Inspections | |
| Specific Gravity | 1.006 |
| Sulfur, wt % | 3.46 |
| Nitrogen, wt % | 0.39 |
| Hydrogen, wt % | 10.65 |
| Carbon, wt % | 85.14 |
| Carbon Residue, wt % | 16.4 |
| Hydrocarbon Type, by wt | |
| Aromatics | 51.0 |
| Saturates | 19.3 |
| Polar Compounds | 25.2 |
| Asphaltenes | 4.5 |

TABLE II

COAL FOR DELAYED COKING OF COAL: VACUUM TOWER BOTTOMS SLURRY

| Coal: | Kentucky Bituminous (Caking) |
|---|---|
| Inspections | |
| Carbon, % by wt | 68.53 |
| Hydrogen, % by wt | 4.60 |
| Nitrogen, % by wt | 1.40 |

TABLE II-continued

COAL FOR DELAYED COKING OF COAL: VACUUM TOWER BOTTOMS SLURRY

| Coal: | Kentucky Bituminous (Caking) |
|---|---|
| Oxygen, % by wt | 5.82 |
| Sulfur, % by wt | |
| Total | 4.63 |
| Inorganic | 1.46 |
| Ash, % by wt | 15.0 |
| Total | 99.98 |
| Volatiles, % by wt | 32.7 |
| Moisture, % by wt | 7.16 |
| Fixed Carbon, % by wt | 44.8 |
| Ash, % by wt | 15.3% |
| Total | 99.96 |

EXAMPLE II

A charge of 1,530 grams, consisting of 20.8 percent Kentucky No. 9 coal as described in Table I and 79.2 percent West Texas crude vacuum tower resid is preheated to 40° C. at an ambient atmospheric pressure of 150 pounds per square inch gauge and blended with paddle stirring until the charge is homogeneous. The charge is then pre-heated to 347° C. and 150 psig and discharged over a 1.5 hour period into a coker heated to 453° C. and 35 psig through a heater with exit temperature of 347° C. The charge is coked by soaking at 435° C. for 4.1 hours and cooled and discharged through the lower manhole.

We claim:

1. In a process for the manufacture of coke from a mixture of coal and a petroleum processing residue, the improvement consisting of mixing 10–30% by-weight coal having a proximate analysis by-weight of about of 32.7% volatiles, 7.2% moisture, 44.8% fixed carbon and 15.3% ash with about 90 to 70% by-weight petroleum processing residue having a weight composition of about 51% aromatics, 19.3% saturates, 25.2% polar compounds and 4.5% asphaltenes with a specific gravity of about 1.006 at a mixing temperature of 50°–65° C. until a homogenous mixture is formed, preheating the homogenous mixture to a temperature of about 350° C. to initiate coalescence of the coal and petroleum residue, coking the mixture to remove volatiles at a temperature of about 435° C. to provide a soft, porous friable sponge-like coke having loose interparticulate bonding.

* * * * *